United States Patent [19]

Lee

[11] Patent Number: 5,007,184

[45] Date of Patent: Apr. 16, 1991

[54] SAFETY SHOE

[76] Inventor: Chien A. Lee, Room 704, No. 592, Lin Sen N. Rd., Taipei, Taiwan

[21] Appl. No.: 369,121

[22] Filed: Jun. 21, 1989

[51] Int. Cl.[5] ..... A43B 23/08

[52] U.S. Cl. ..... 36/77 R; 36/72 R

[58] Field of Search ..... 36/72 R, 77 R

[56] References Cited

U.S. PATENT DOCUMENTS

| | | | |
|---|---|---|---|
| Re. 1,339 | 9/1862 | Silverhorn | 36/77 R |
| 1,734,531 | 11/1929 | Ryan | 36/77 R |
| 2,020,037 | 11/1935 | McMurray | 36/72 R |
| 2,795,868 | 6/1957 | Shultz | 36/77 R |
| 3,034,235 | 5/1962 | Hunting et al. | 36/77 R |

FOREIGN PATENT DOCUMENTS

| | | | |
|---|---|---|---|
| 839484 | 4/1970 | Canada | 36/77 R |
| 1098708 | 1/1968 | United Kingdom | 36/77 R |

OTHER PUBLICATIONS

UK Patent Application GB 2138272A, pub. 10-1984, 36/72R, Smith.

UK Patent Application GB 2176690A, pub. 01-1987, 36/72 R, Durey.

*Primary Examiner*—Steven N. Meyers

*Attorney, Agent, or Firm*—Morton J. Rosenberg; David I. Klein

[57] ABSTRACT

A safety shoe including a steel toe box having an inwardly turned relatively wide flange, the flange having a larger width at two end portions and having a smaller width at a central portion, the flange having a gradually thinner thickness from the junction portion to the edge; a polyethylene liner for cooperating with the toe box; a U-shaped pad made of hardened material having a size and shape substantially matching with a size and shape of the flange of the steel toe box for supporting the steel toe box; and a middle sole having a U-shaped cutout for matching and retaining the U-shaped pad.

2 Claims, 3 Drawing Sheets

SAFETY SHOE

BACKGROUND OF THE INVENTION

The present invention relates generally to safety shoes, and more particularly, to an improved safety shoe.

Conventional steel toe box has inwardly turned relatively wide flange of equal width and thickness. Due to the equal width and thickness of the flange, ruffles formed at the tip of the safety shoe when fixing the upper. When the upper was combined to the sole, the skirt of the upper had to be pulled a considerable distance beyond the flange of the steel toe box. The longer the skirt being pulled, the more the ruffles form. Too many ruffles often resulted in poor combination between the upper and the sole. Generally, the skirt of the upper could not be pulled too much as this caused a bulge to form at the sole and thus caused the shoe unfit for wearing.

The present invention has been arisen to provide a safety shoe which mitigates and/or obviates the aforementioned drawbacks of conventional safety shoe.

SUMMARY OF THE INVENTION

It is therefore a primary object of the present invention to provide a safety shoe which comprises a steel toe box having a structure which is capable of reducing the formation of ruffles so as to facilitate the engagement of the upper to the sole.

It is also a primary object of the present invention to provide a safety shoe which comprises a steel toe box having a structure which eliminates the need of pulling the skirt of the upper a considerable distance beyond the flange of the steel toe box for combining the upper to the sole.

Another object of the present invention is to provide a safety shoe which comprises a steel toe box which has an inwardly turned relatively wide flange having a larger width at two end portions while having a smaller width at the middle portion.

A further object of the present invention is to provide a safety shoe which comprises a steel toe box which has an inwardly turned relatively wide flange having gradually thinner thickness from the junction portion to the edge.

Still another object of the present invention is to provide a safety shoe which comprises a U-shaped pad which matches the middle sole to facilitate the combination of the safety shoe.

Further objects and advantages of the present invention will be apparent to those skilled in the art upon reading the detailed description provided herein-below, with reference to the attached drawings.

DETAILED DESCRIPTION OF THE PREFERRED EMBODIMENTS

Figure 1:
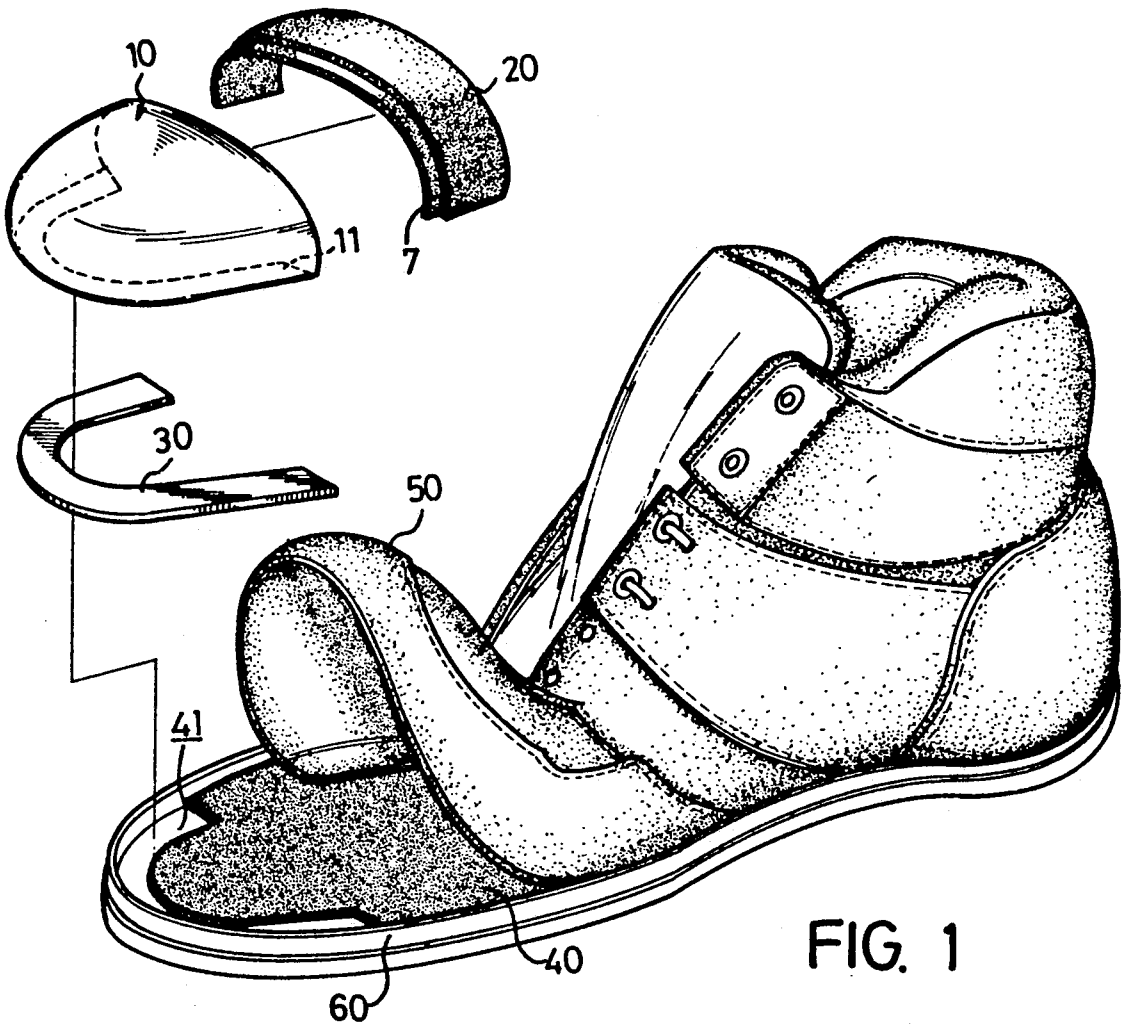
FIG. 1 is an exploded view of a safety shoe in accordance with the present invention.
Figure 3:
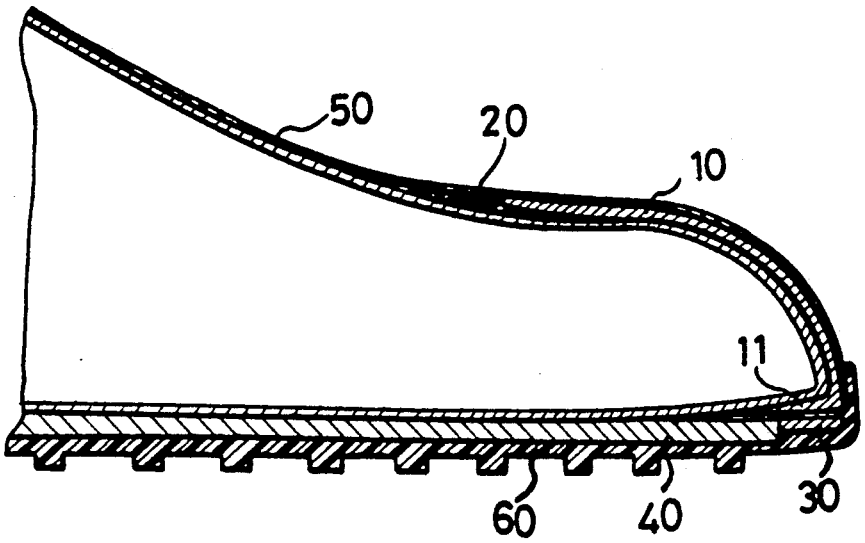
FIG. 3 is a partially cutaway lengthwise sectional view of the safety shoe shown in FIG. 1 after assembly.
Figure 5:
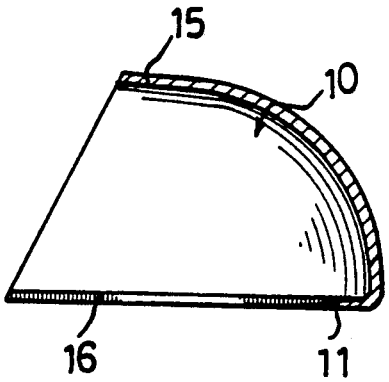
FIG. 5 shows a lengthwise sectional view of another embodiment of the steel toe box of the present invention.

Referring to the drawing and initially to FIG. 1, it can be seen that the safety shoe in accordance with the present invention comprises a steel toe box 10 which has an inwardly turned relatively wide flange 11, a polyethylene liner 20 for cooperating with the steel toe box 10 with the polyethylene liner 20 having a shoulder 7 for mounting and partial contiguous interface between the liner 20 and the toe box 10, and a U-shaped pad 30 for holding the steel toe box 10. As shown in FIG. 3, the thickness of the U-shaped pad (30) is less than the thickness of the middle sole (40). The middle sole 40 is provided with a U-shaped cutout 41 for matching and retaining the U-shaped pad 30. As shown in FIG. 5, the front end of the middle sole 40 lies below the flange (11).

Figure 2:
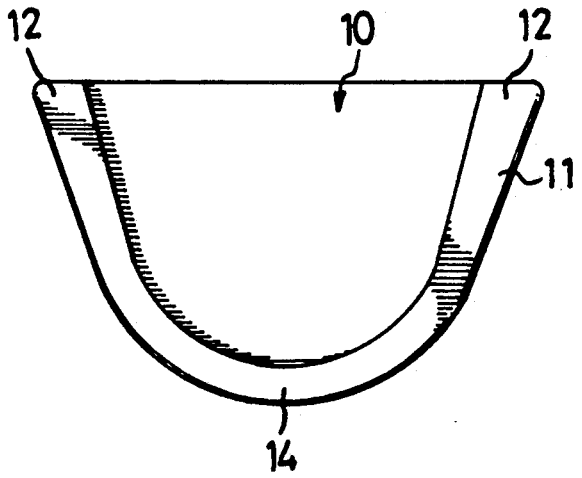
FIG. 2 is a bottom view of the steel toe box shown in FIG. 1.

Referring further to FIG. 2, it can be seen that the flange 11 has a non-uniform width. The flange 11 has a larger width at two end portions 12 for ensuring equally good engaging effect and has a smaller width at the central portion 14 for reducing the formation of ruffles at the tip of the shoe during the engagement of the upper 50 to the sole 60.

It should be noted that the construction of the flange 11 of the steel toe box 10 depends very much on the tensile strength thereof. Due to the continuous formation of the central portion 14, the tensile strength at that portion is larger, and therefore, the flange 11 could have smaller width at the central portion 14. Conversely, the steel toe box 10 is weaker in tensile strength at the two end portions 12 than the central portion 14, and therefore, the flange 11 should have larger width at the two end portions 12 relative to the central portion 14.

It is this smaller width of flange 11 at the central portion 14 that is responsible for reducing the formation of ruffles at the tip of the shoe during the engagement of the upper 50 to the sole 60.

The polyethylene liner 20 is adapted to combine with the steel toe box 10 in a conventional manner which requires no further description.

Referring next to FIGS. 1 and 3, it can be seen that the size and shape of the U-shaped pad 30 matches with the size and shape of the U-shaped cutout 41 of the middle sole 40; also, the size and shape of the U-shaped pad 30 substantially matches with the size and shape of the flange 11 of the steel toe box 10. The flange 11 of the steel toe box 10 is placed on the U-shaped pad 30 upon assembly. Preferably, the U-shaped pad 30 is made of hardened material and the provision thereof is to take the place of middle sole 40 which is made of softer material so as to protect the middle sole 40 and the sole 60 from abrasion by the steel toe box 10.

Figure 4:
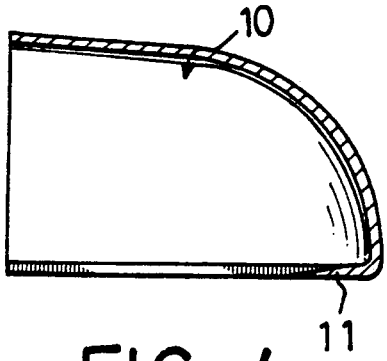
FIG. 4 is a lengthwise sectional view of the steel toe box shown in FIG. 1.

Referring next to FIGS. 1 and 4, it can be seen from this sectional view that the flange 11 of the steel toe box 10 has a non-uniform thickness. The flange 11 has a gradually thinner thickness from the junction portion to the edge, so as to form a wedge shape.

The wedge-shaped structure of the flange 11 enables the upper 50 to extend over the flange 11 more easily and thus the upper 50 can be glued to the sole 60 readily.

Referring next to FIG. 5, it can be seen that another embodiment of the steel toe box 10 in accordance with the present invention has a shortened upper back structure 15. As shown in FIG. 5, the thickness of the upper back portion (15) is uniform and does not taper as the thickness of the flange (11) does. In other words, the upper back portion 15 of the toe box 10 is shorter than the lower portion 16 thereof. Safety shoes having this steel toe box 10 are particularly suitable in the case where only the toe portion of the user is to be protected. The steel toe box 10 has a shape where the upper back portion 15 thereof is shortened such that the safety shoes are more comfortable for wearing.

While the present invention has been explained in relation to its preferred embodiment, it is to be understood that various modifications thereof will be apparent to those skilled in the art upon reading this specification. The invention disclosed herein is therefore intended to cover all such modifications as fall within the scope of the appended claims.

I claim:

1. A safety shoe comprising:

a steel toe box (10) having an inwardly turned relatively wide flange (11), said flange (11) having a larger width at two opposing respective end portions (12) and having a smaller width at a central portion (14) for increasing the tensile strength of said toe box (10), said flange (11) having a gradually thinner thickness from a junction portion to an edge thereof;

a polyethylene liner (20) having a shoulder for mounting and partial contiguous interface with said steel toe box (10);

a U-shaped pad (30) made of a hardened material having a size and shape substantially matching with a size and shape of said flange (11) of said steel toe box (10) for supporting said steel toe box (10); and, a middle sole (40) having a front end that lies below a front end of said flange (11) and having a U-shaped cutout (41) for alignment with and retention of said U-shaped pad (30), said middle thickness sole (40) having a thickness that is greater than a thickness of said U-shaped pad (30).

2. A safety shoe as claimed in claim 1, wherein an upper back portion (15) of said steel toe box (10) is shorter than a lower portion (16) thereof and a thickness of said upper back portion (15) is uniform.

* * * * *